US006343708B1

(12) United States Patent
Riso

(10) Patent No.: US 6,343,708 B1
(45) **Date of Patent: *Feb. 5, 2002**

(54) STORAGE ASSEMBLY FOR ACCESSING SMALL TOOLS AND COMPONENTS

(76) Inventor: John Riso, 226 Grove St., Verona, NJ (US) 07044

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/326,892

(22) Filed: Jun. 7, 1999

(51) Int. Cl.[7] ..... B65D 21/00

(52) U.S. Cl. ..... 220/23.88; 206/373; 220/527; 220/771; 220/796; 220/801

(58) Field of Search ..... 220/500, 503, 220/516, 521, 526, 527, 212.5, 23.6, 23.88, 485, 771, 796, 801; 217/7, 16, 30, 29, 35, 42; 206/499, 743, 744, 373; 190/5, 35, 21, 33, 110; 224/404; 229/117.16

(56) References Cited

U.S. PATENT DOCUMENTS

| | | | | | |
|---|---|---|---|---|---|
| 258,814 | A | * | 5/1882 | Scott | 190/16 |
| 323,714 | A | * | 8/1885 | Morrison et al. | 217/42 X |
| 1,566,856 | A | * | 12/1925 | Gregory | 220/521 X |
| 2,247,341 | A | * | 6/1941 | Anderson | 217/18 X |
| 2,290,681 | A | * | 7/1942 | Fussner | 220/521 X |
| 2,351,825 | A | * | 6/1944 | Limbert | 229/117.16 |
| D142,712 | S | * | 10/1945 | Gilchrist | 220/212.5 X |
| 2,421,264 | A | | 5/1947 | Herwig | |
| 2,614,399 | A | | 10/1952 | Roethel | |
| 2,635,779 | A | | 4/1953 | Pfeiffer | |
| 2,731,996 | A | * | 1/1956 | Hayes | 220/526 X |
| 2,801,742 | A | * | 8/1957 | Farrell | 217/42 X |
| 2,851,188 | A | * | 9/1958 | Pavelle | 220/23.6 X |
| 2,870,932 | A | * | 1/1959 | Davis | 220/521 |
| 2,944,694 | A | | 7/1960 | Kinsey | |
| 3,037,658 | A | | 6/1962 | Schray et al. | |
| 3,355,054 | A | * | 11/1967 | Wilson | 220/23.6 |
| 3,437,389 | A | * | 4/1969 | Perkins et al. | 312/902 |
| 3,565,278 | A | * | 2/1971 | Rehrig | 220/516 |
| 3,565,325 | A | * | 2/1971 | Pugsley | 229/117.16 |
| 3,900,157 | A | * | 8/1975 | Roth | 229/117.16 |
| 4,015,712 | A | | 4/1977 | Wadensten | |
| 4,273,346 | A | * | 6/1981 | Rehrig | 220/485 X |
| 4,294,359 | A | * | 10/1981 | Berkel | 206/442 |
| 4,512,489 | A | * | 4/1985 | Green et al. | 220/516 X |
| 4,529,088 | A | * | 7/1985 | Ouong | 220/23.6 X |
| 4,826,007 | A | | 5/1989 | Skeie | |

(List continued on next page.)

FOREIGN PATENT DOCUMENTS

| | | | | |
|---|---|---|---|---|
| GB | 440718 | * | 1/1936 | 229/117.16 |

*Primary Examiner*—Stephen P. Garbe
*Assistant Examiner*—Joseph C. Merek
(74) *Attorney, Agent, or Firm*—Anthony J. Casella; Gerald E. Hespos

(57) ABSTRACT

A storage assembly is provided for the accessible storage of small tools and components. The assembly includes a rectangular open-topped outer container having internal length and width dimensions that are selected integer multiples of a selected dimension. The outer container may have hand grips formed in the sidewalls in proximity to the open top for lifting the outer container and the entire assembly. The assembly also includes a plurality of rectangular open-topped inner containers having length and width dimensions that equal the selected dimensions employed in the outer container. Thus, if the inner containers have length and/or width dimensions of X, the outer container may have length and width dimensions of 3x and 2x respectively. Thus, a plurality of the inner containers may be stored efficiently in the outer container. The inner containers are configured to be stackable so that a plurality of tiers of inner containers can be stored in the outer container. Additionally, the inner containers are configured to be slidable on one another to facilitate access to inner containers in a lower tier.

8 Claims, 6 Drawing Sheets

U.S. PATENT DOCUMENTS

| | | | | |
|---|---|---|---|---|
| 4,844,279 | A | | 7/1989 | Chalat |
| 4,844,305 | A | * | 7/1989 | McKneely ..... 224/404 |
| 4,867,332 | A | | 9/1989 | Mains |
| 4,911,295 | A | | 3/1990 | Venegoni |
| 4,981,254 | A | * | 1/1991 | Depper ..... 229/117.16 |
| 5,011,013 | A | | 4/1991 | Meisner et al. |
| 5,350,065 | A | | 9/1994 | Darrey |
| 5,441,163 | A | | 8/1995 | Carrasco |
| 5,495,960 | A | | 3/1996 | Lam et al. |
| 5,501,338 | A | * | 3/1996 | Preston ..... 206/545 |
| 5,547,098 | A | | 8/1996 | Jordan |

* cited by examiner

STORAGE ASSEMBLY FOR ACCESSING SMALL TOOLS AND COMPONENTS

BACKGROUND OF THE INVENTION

1. Field of the Invention

The subject invention relates to an assembly of containers for convenient storage of tools, and other items and parts and for subsequent convenient access to the stored items.

2. Description of the Related Art

Contractors and many do-it-yourself workers maintain an inventory of small hand tools and a larger inventory of parts that may be used or installed with the tools. The tools are likely to include hammers, screwdrivers, wrenches, pliers, wire strippers, hack saws, punches, caulking guns and flashlights, to name a few. The parts are likely to include nails, screws and bolts of varying sizes and shapes, wire nuts, electrical connectors, pipe fittings and caulking cartridges.

Some contractors and do-it-yourself workers employ conventional tool boxes for storing, carrying and accessing tools and parts. Prior art tool boxes have come in many different sizes, shapes and internal constructions. A typical prior art tool box will include one large compartment with a hinged cover. The large compartment typically is dimensioned for receiving tools. Several smaller compartments are movably joined to the remainder of the tool box by hinges and/or tracks. The smaller compartments typically are used to hold small parts, such as screws or nails. Tool boxes are used by some homeowners and by certain repairmen for brand name appliances. Many contractors, and do-it-yourself workers do not use tool boxes because of the relatively high cost, inconvenient access and limited versatility.

Prior art storage systems used by many contractors and do-it-yourself workers are open-topped containers that originally were intended for some other purpose. In particular, five gallon plastic pails that had originally contained joint compound are widely used for storing and transporting tools and parts. Tools and/or parts typically are stored loosely in the open top five gallon pail. Workers often spend considerable time each day manually sifting through the parts pail in an effort to find a required fitting, fastener or the like. Other workers start each day by dumping their parts pail onto a section of floor where they will be working. The respective parts then are sorted on the floor and accessed as needed. The parts then are scooped back into the five gallon plastic pail at the completion of the work day.

The inefficiencies of using a conventional five gallon plastic pail for storing and carrying tools and parts have lead to the development of many storage systems that are supported on the walls of the pail. The typical storage system includes hanging brackets with apertures for receiving various tools. An example of such a tool holder is shown in U.S. Pat. No. 4,867,332. Other tool organizers for five gallon plastic pails are circular trays that are supported on a central post in the pail. The assembly within the pail functions like a lazy-susan. A prior art system like this is shown in U.S. Pat. No. 5,441,163.

Another tool storage container of choice among many contractors is a rectangular open-topped plastic container used to carry containers of milk into and within a food store. These containers typically have unitarily molded sidewalls that resemble a lattice work and that have hand grip openings at central positions at each sidewall and end wall near the open top of the container. Containers of this type often are used to carry tools and larger parts such as some pipe fittings and duct fittings that will not fall through the openings in the walls of the container. These containers suffer from many of the same inefficiencies as the above-described five gallon cylindrical plastic pails. In particular, the worker must manually sort through a random array of tools and parts in the container to access a particular tool or part. These rectangular containers offer certain advantages over the above-described five gallon cylindrical plastic pails. In particular, the rectangular containers tend to be shorter and wider and hence offer greater stability when transported in the back of a van or pick-up truck. Additionally, the rectangular shape lends itself well to a neater storage array.

SUMMARY OF THE INVENTION

The subject invention is directed to an open-topped rectangular outer container having a plurality of rectangular open-topped inner containers movably disposed in the outer container. The outer container may be unitarily molded from a plastic material and may have a plurality of lattice-type walls. Thus, the outer container may be the type of container conventionally used for storing and carrying containers of milk in a dairy section of a food store. The outer container includes a rectangular bottom wall, a pair of opposed parallel rectangular end walls extending perpendicularly from the bottom wall and a pair of parallel sidewalls extending perpendicularly between the end walls and perpendicularly from the bottom wall. At least the end walls are provided with hand grip openings near the open top of the container. The hand grip openings in the end walls may be centrally disposed between the sidewalls of the outer container. The sidewalls of the outer container may also include hand grip openings near the open top. The hand grip openings in the sidewalls also may be centrally disposed between the end walls. Planar panels may be formed on the sidewalls or end walls to accommodate trademarks and/or to receive labels to identify parts stored in the container.

The absolute dimensions of the outer container are not important, and merely are limited by the need for convenient storage and carrying of the outer container. However, the relative dimensions of the various walls of the outer container relative to one another and relative to the inner containers is important. In particular, the end walls of the outer container preferably define an internal width of aX, while the sidewalls of the outer container preferably define an internal length of bX. In this regard, X may be any convenient selected dimension and preferably in the range of about –8 inches. Additionally, "a" and "b" each are integers. Thus, the internal width and the internal length of the outer container are substantially equal to a selected dimension multiplied by a selected integer "a" or "b". In a preferred embodiment, as explained further herein, the dimension X is approximately equal to six inches, and the integers "a" and "b" are 2 and 3 respectively. Thus, in the preferred embodiment, the internal dimensions of the outer container are about twelve inches by eighteen inches.

The relative dimensions of the outer container are further characterized by a distance between the bottom wall and the bottom of the hand grips which is equal to cY. In this context, Y is a selected convenient dimension, and "c" is a selected integer. Additionally, "c" may be equal to "a" or "b". In a preferred embodiment, as explained further herein, dimension "Y" equals approximately four inches, and integer "c" equals 2. Thus, in this preferred embodiment, the distance between the bottom wall and the bottom of the hand grips is approximately eight inches.

The inner containers are rectangular and open topped. In particular, each inner container has a bottom wall and pairs of opposed parallel upstanding sidewalls that are perpendicular to the bottom wall. The sidewall of the inner containers are not tapered in a manner that would permit nesting of outer containers. Thus, the outer containers are stackable on top of one another without nesting. Additionally, the thicknesses of the sidewalls, at least at the top, are sufficiently great so that the bottom wall of one inner container can be supported conveniently by the top edges of the sidewalls of another inner container. The inner containers preferably have external length and external width dimensions that are approximately equal to X or to some integer multiple of X, such as aX or bX. Thus, some inner containers may have an external length dimension of aX and an external width dimension of X. Additionally, each of the inner containers has a height dimension of Y or possibly a hype dimension of some integer multiple of Y.

With the above-described construction and dimensions, a plurality of the inner containers may be arranged in a lower tier within the outer container. Additionally, a second plurality of inner containers may define a second tier of inner containers that is supported on the first tier. The inner containers may be removed and replaced to enable a worker to carry to a work site an appropriate collection of inner containers suitable for a job to be performed on a particular day. Inner containers may be separately removed from the outer container and replaced or may be removed to access another inner container. Furthermore, a single inner container in the second tier may be removed, and the remaining inner containers in the second tier may be slid lengthwise and/or widthwise to access a particular inner container in the first tier. The sliding movement is achieved without rails and merely by virtue of the ability of the non-nestable inner containers to be supported on one another. Some inner containers that have length and width dimensions of X and 2X may extend the entire width of the outer container but only one-third the length. A container of this dimension and with the preferred dimension X equal to six inches will be sufficiently large to store several standard caulking cartridges. An inner container having length and width dimensions of X and 3X could fit along the length of the outer container and across half the width. An inner container of this size can accommodate a hacksaw, hammer or fairly large wrench.

As noted above, the inner containers preferably have a height of Y. Thus, two inner containers stacked one on the other will extend from the bottom wall to a location at the bottom of the hand grips on the outer container. Thus, two tiers of inner containers will not impede the ability to lift the outer container by the hand grips.

The subject invention may further include at least one diagonal storage wall that can be slidably inserted along a diagonal on at least one of the inner containers. Thus, a diagonal wall insert will enable an inner container to be divided into two triangular containers that are smaller than the inner container.

The subject invention may further include a substantially solid cover with length and width dimensions substantially equal to the internal length and width dimensions of the outer container. Additionally, the cover may have a thickness equal to the distance from the bottom of the hand grip openings and the top of the container. Thus, the cover may define a flush top for the outer container that will safely and conveniently close all of the inner containers simultaneously. The cover may include recesses registered with the hand grip openings so that the cover does not impede the ability to grip the container assembly by the hand grips. The cover may be stopped, and may have a lower portion dimensioned to telescope into the open top of the outer container and an upper portion dimensioned to rest on the top edges of the side and end walls of the outer container.

The container assembly may further include a tray having length and width dimensions equal to the internal length and width dimensions of the outer container. Thus, the tray may be inserted into the outer container and may be supported on the first and/or second tiers of inner containers. The tray may include a plurality of smaller compartments therein. The tray may have a height less than the distance between the bottom of the hand grip openings and the top of the container, and the tray may have a cover. In this embodiment, the combined dimensions of the tray and the cover may be selected not to exceed the distance between the bottom of the hand grip openings and the top of the outer container.

A plurality of the container assemblies may be used in combination and may be connected to one another by a common cover having projections that extend into the open tops of the respective containers. The common cover may serve the dual function of closing all containers and holding all outer containers in alignment with one another. In this manner, the common cover may enable a plurality of the container assemblies to function as a bench to sit or work on. Additionally, the covers on a plurality of outer containers may facilitate the ability of a worker to either crawl across a plurality of such container assemblies stored in the back of a van or to support other materials on a plurality of such covers, such as large ducts, pipes, studs or structural panels.

DETAILED DESCRIPTION OF THE PREFERRED EMBODIMENTS

Figure 1:
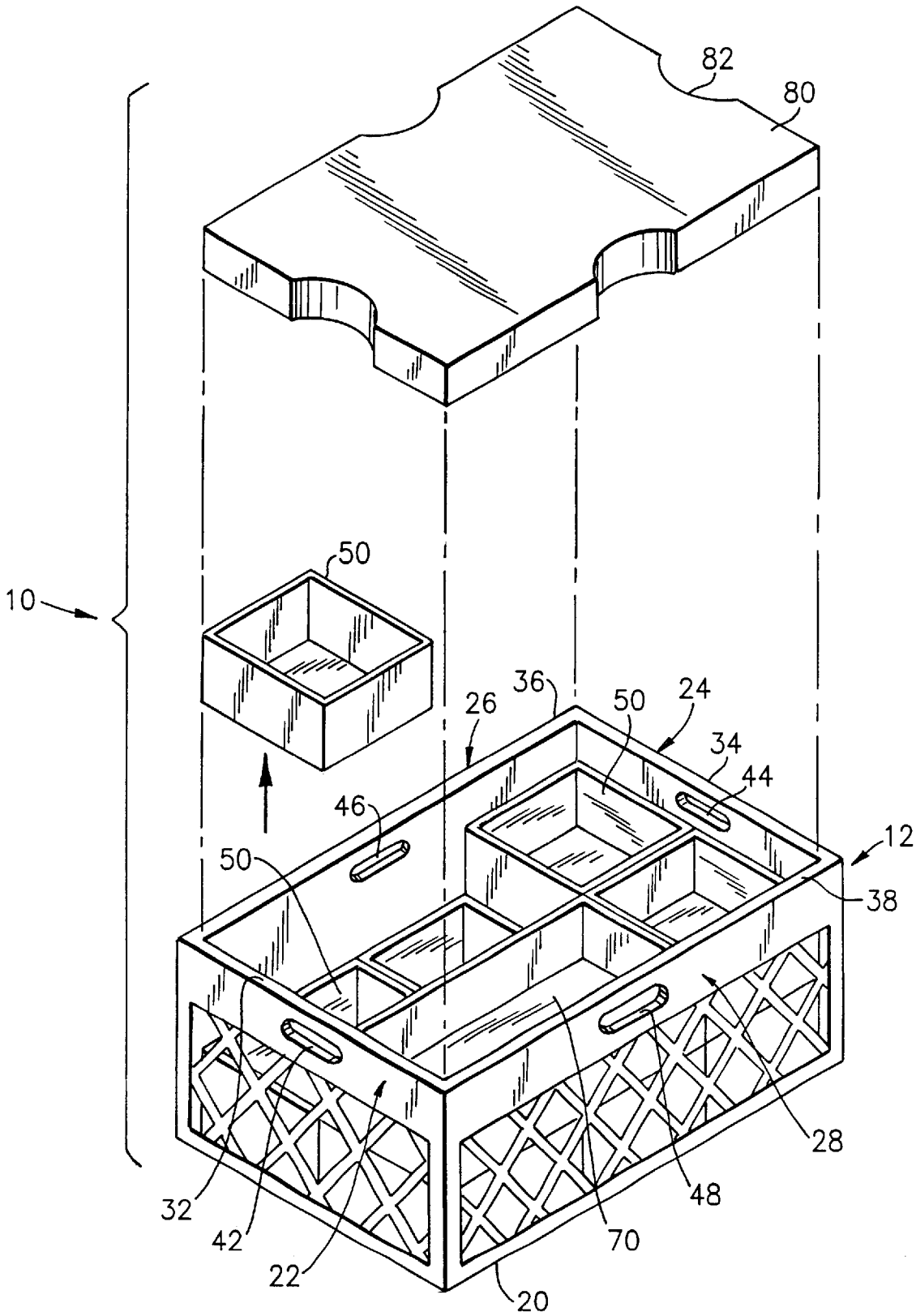
FIG. 1 is an exploded perspective view of a container assembly in accordance with the subject invention.
Figure 2:
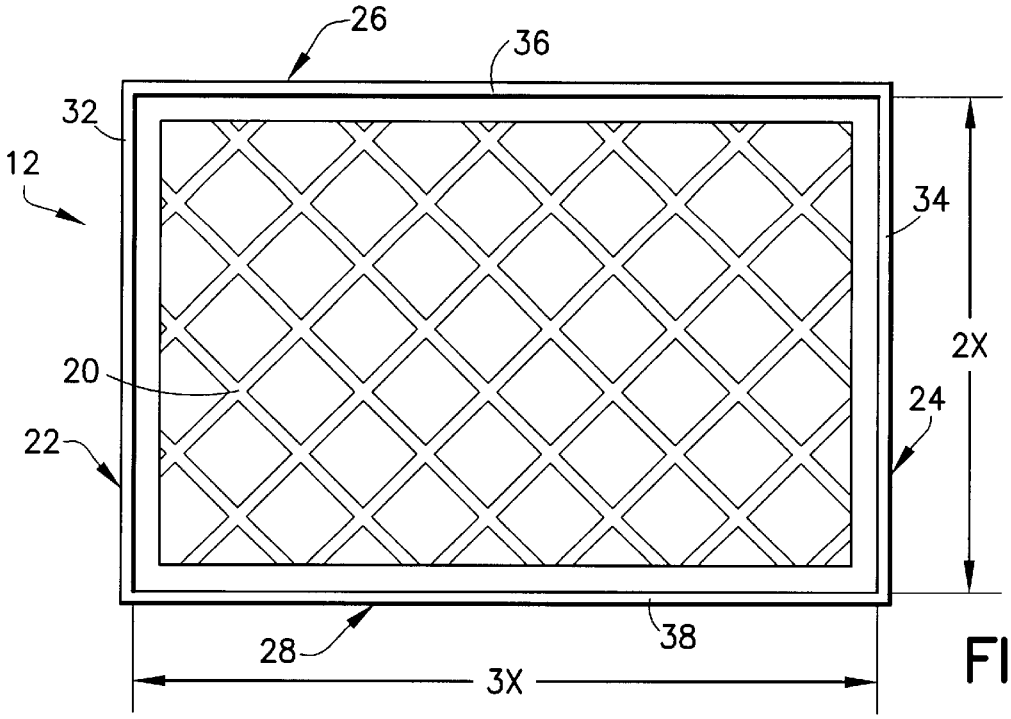
FIG. 2 is a top plan view of an outer container in accordance with the subject invention.
Figure 3:
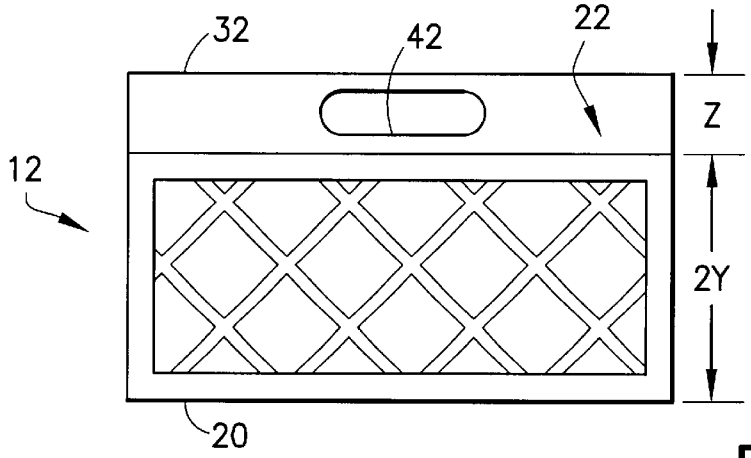
FIG. 3 is an end elevational view of the outer container shown in FIG. 2.
Figure 4:
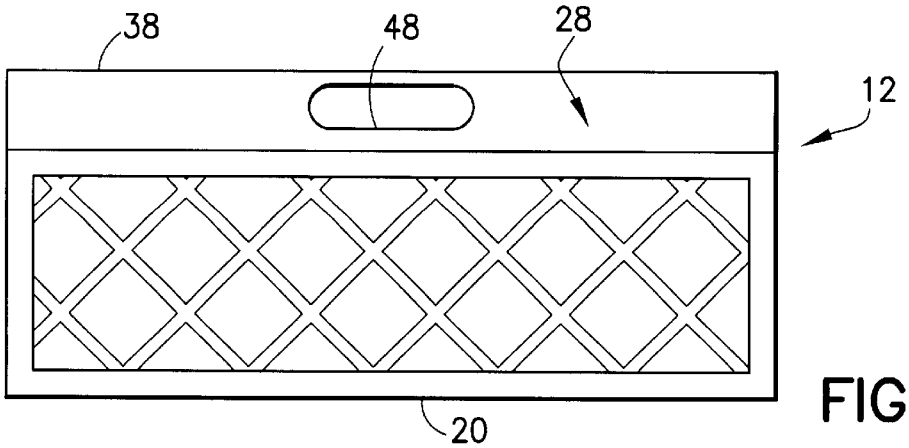
FIG. 4 is a front elevational view of the outer container shown in FIGS. 1–3.

A storage container assembly in accordance with the subject invention is identified generally by the numeral 10 in FIGS. 1 and 12–19. The storage container assembly 10 includes a substantially rectangular open-topped outer container 12. The outer container 12 preferably is unitarily molded from a plastic material and includes a rectangular bottom wall 20. Opposed parallel rectangular end walls 22 and 24 extend perpendicularly upwardly from the bottom wall 20. Opposed parallel rectangular sidewalls 26 and 28 extend perpendicularly upwardly from the bottom wall 20 and perpendicularly between the end walls 22 and 24. The end walls 22 and 24 include top edges 32 and 34 respectively. Similarly, the sidewalls 26 and 28 include top edges 36 and 38. The end walls 22 and 24 are formed with hand grips 42 and 44 that are spaced slightly below the top edges 32 and 34 respectively. Similarly, the sidewalls 26 and 28 include hand grips 46 and 48 spaced slightly below the top edges 36 and 38 respectively.

The relative dimensions of the outer container 12 are important as compared to dimensions of other parts of the assembly as described below. In particular, the sidewalls 26 and 28 are spaced from one another by an internal width which is equal to a selected integer multiplied by a selected dimension. Thus, the internal width of the outer container 12, as measured by the distance between the sidewalls 26 and 28, is equal to aX, where A is a selected integer and where X is a selected dimension. In the preferred embodiment illustrated herein, the integer "a" is 2 and the internal width is equal to 2X. Additionally, in the preferred embodiment, X preferably is equal to approximately six inches. Thus the internal width is about 12 inches.

In a similar manner, the end walls 22 and 24 preferably are spaced from one another by an internal length that is equal to a selected integer multiplied by the selected dimension. Thus, the internal length between the end walls 22 and 24 may be expressed as bX. In the preferred embodiment illustrated herein, the internal length is equal to 3X.

The internal height of the outer container 12, as measured from the bottom wall 20 to the bottom edge of the respective hand grips, 42, 44, 46 and 48 is equal to a selected integer multiplied by a selected dimension. Thus, the height from the bottom wall 20 to the bottom of the hand grips may be expressed as cY, where "C" is the selected integer and Y is the selected dimension. In the preferred embodiment illustrated herein, the height measured from the inner surface of the bottom wall 20 to the bottom of the hand grips 44–48 is equal to 2Y where Y is equal to approximately four inches.

The distance from the bottom edges of the hand grips 44–48 to the top edges 32–38 of the side and end walls 22–28 is defined by dimension "Z" which also is relevant to other dimensions described further below.

Outer surface regions of the side and end walls 22–28 of the outer container 12 may include planar panels for carrying trademark indicia or labels to identify stored items. The labels may be rewritable to facilitate revisions as the stored items change.

Figure 5:
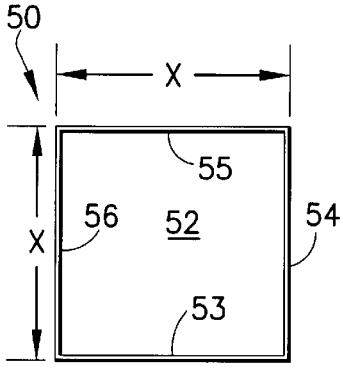
FIG. 5 is a top plan view of an inner container.
Figure 6:
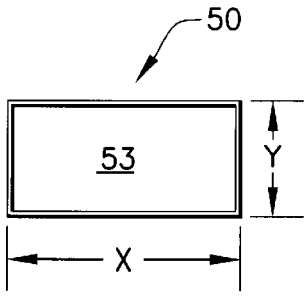
FIG. 6 is a side elevational view of an inner container.

The assembly of the subject invention further includes a plurality of inner containers. The inner containers may all be identical to one another or may include a plurality of different types of inner containers as explained herein. A first inner container is identified generally by the numeral 50 in FIGS. 5–7. The inner container 50 includes a square bottom wall 52 and four identical rectangular sidewalls 53–56 extending perpendicularly upwardly from the bottom wall 52. The sidewalls 53 and 55 are substantially parallel to one another, and the sidewalls 54 and 56 are parallel to one another and perpendicular to the sidewalls 53 and 55. As shown most clearly in FIG. 5, the sidewalls 53–56 of the first inner container 50 have external width dimensions X, which in the preferred embodiment is equal to approximately six inches. Additionally, as shown in FIG. 6, the sidewalls 53–56 of the first inner container 50 all have an external height Y, which is equal to approximately four inches in the preferred embodiment. The inner containers 50 preferably are formed from a unitary sheet of galvanized metal that has been cut, folded and welded at seams. Additionally, the top edges of the sidewalls 53–56 preferably are folded over to avoid sharp edges and to provide a greater top width for reasons explained further herein. Although the galvanized sheet metal is preferred for the inner containers, other metal materials or synthetic materials may be employed. For example, the inner containers can be unitarily molded from plastic. However, the outer dimensions X of the bottom wall 52 must exceed the inner dimensions defined by the sidewalls 54–56 at the open top of the inner container 50. This configuration of the sidewalls and bottom walls of the inner container 50 enable one inner container 50 to be stacked on another inner container 50 without a telescoped nesting of one inner container 50 within another.

Figure 7:
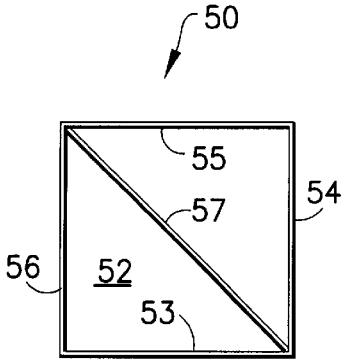
FIG. 7 is a top plan view of an alternate inner container showing a diagonal dividing wall.

FIG. 7 shows a slight adaptation of the inner container 50. In particular, the inner container 50 shown in FIG. 7 is provided with a diagonal wall 58 that has been telescoped into the open top to extend from a corner at the intersection of sidewalls 53 and 54 to the corner defined by the intersection of the sidewalls 55 and 56. The diagonal wall 58 divides the inner container 50 into two separated small triangular compartments.

Figure 8:
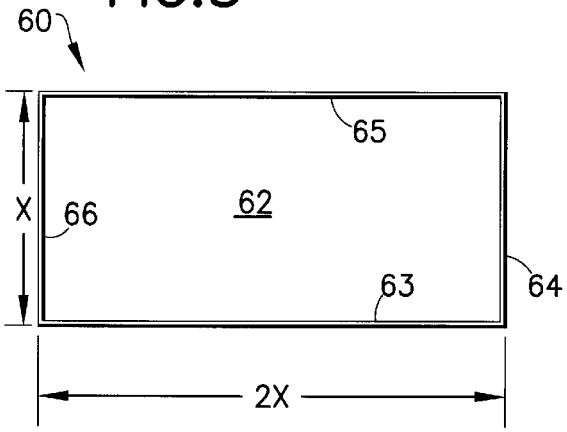
FIG. 8 is a top plan view of a second inner container.
Figure 9:
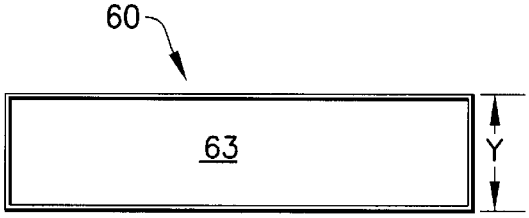
FIG. 9 is a front elevational view of the second inner container.

A second inner container is identified generally by the numeral 60 in FIGS. 8 and 9. The second inner container 60 has a bottom wall 62 defining an external width X and an external length 2X. Thus, the bottom wall 62 of the second inner container 60 is twice the size of the bottom wall 52 on the first inner container 50. The second inner container 60 includes opposed identical rectangular sidewalls 63 and 65 that extend perpendicular upwardly from the long sides of the bottom wall 62. The second inner container further includes identical parallel rectangular end walls 64 and 66 that extend perpendicularly upwardly from the bottom wall 62 and perpendicularly between the sidewalls 63 and 65. The sidewalls 63 and 65 and the end walls 64 and 66 all are of substantially equal height Y, as shown most clearly in FIG. 9. The second inner container 60 is formed substantially in the same manner as the first inner container 50. In particular, the preferred second inner container 60 is formed from a galvanized metal that has been cut, folded and welded into the illustrated shape. Additionally, the second inner container 60 must be formed in a manner to ensure that the inside dimensions at the open top are less than the outside dimensions X and 2X at the bottom wall 62. Thus, as explained with respect to the first inner container 50, a plurality of second inner containers 60 may be stacked on top of one another. Additionally, two first inner containers 50 can be stacked on top of one second inner container 60, and a second inner container 60 can be stacked on two first inner containers 50.

Figure 10:
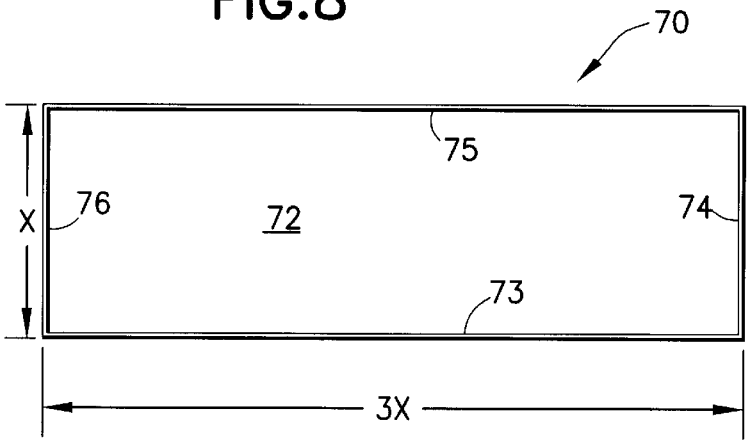
FIG. 10 is a top plan view of a third inner container.
Figure 11:
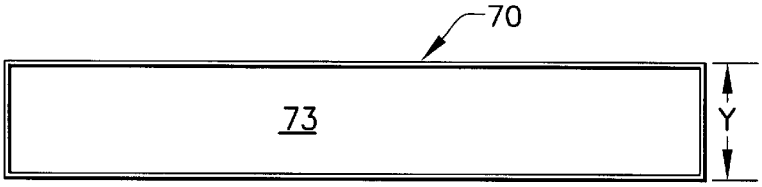
FIG. 11 is a front elevational view of the third inner container.

A third inner container is identified generally by the numeral 70 in FIGS. 10 and 11. The third inner container includes an elongate rectangular bottom wall 72 having a width X and a length 3x. A pair of opposed identical rectangular sidewalls 53 and 55 extend perpendicularly upwardly from the bottom wall 72 and parallel to one another. A pair of opposed identical rectangular end walls 74 and 76 extending perpendicularly upwardly from the bottom wall 72 and perpendicularly between the sidewalls 73 and 75. As shown in FIG. 11, the sidewalls 73 and 75 and the end walls 74 and 76 all have a height Y. The third inner container 70 is formed substantially in the same manner as the first and second inner containers described above.

The relative dimensions of the first through third inner containers 50, 60 and 70 substantially prevent nesting of any inner containing within another, but readily permit various combinations of the inner containers 50, 60 and 70 to be nested within the outer container 12. In particular, two first inner containers 50 can be positioned adjacent one another between the sidewalls 26 and 28 of the outer container 12. Additionally, three of the first inner containers 50 can be positioned between the end walls 22 and 24 of the outer container 12. Thus, a tier of six first inner containers 50 can be positioned on the bottom wall 20 of the outer container 12.

The relative dimensions of the second inner container 60 enable the second inner container to be positioned with its end walls 54 and 56 between and adjacent the sidewalls 26 and 28 of the outer container 12. Three identical second inner containers can be positioned side-by-side between the end walls 22 and 24 of the outer container 12. Alternatively, one first inner container 50 and one second inner container 60 can be positioned in abutting relationship and extending between the end walls 22 and 24 as shown in FIG. 1.

The relative dimensions described above also enable a third inner container 70 to extend continuously between the end walls 22 and 24 of the outer container 12.

The height dimensions Y of the inner containers 50, 60 and 70 enable two inner containers 50, 60 and/or 70 to be stacked one on top of another in the outer container 12. In this stacked orientation, the upper of the inner containers 50, 60 or 70 will have its top edge no higher than the bottom edge of the hand grips 42, 44, 46 or 48. Hence, two tiers of inner containers 50, 60 and 70 may be stacked within the outer container 12 without impeding the ability to lift the assembly 10 by a pair of hand grips 42–48.

Figure 12:
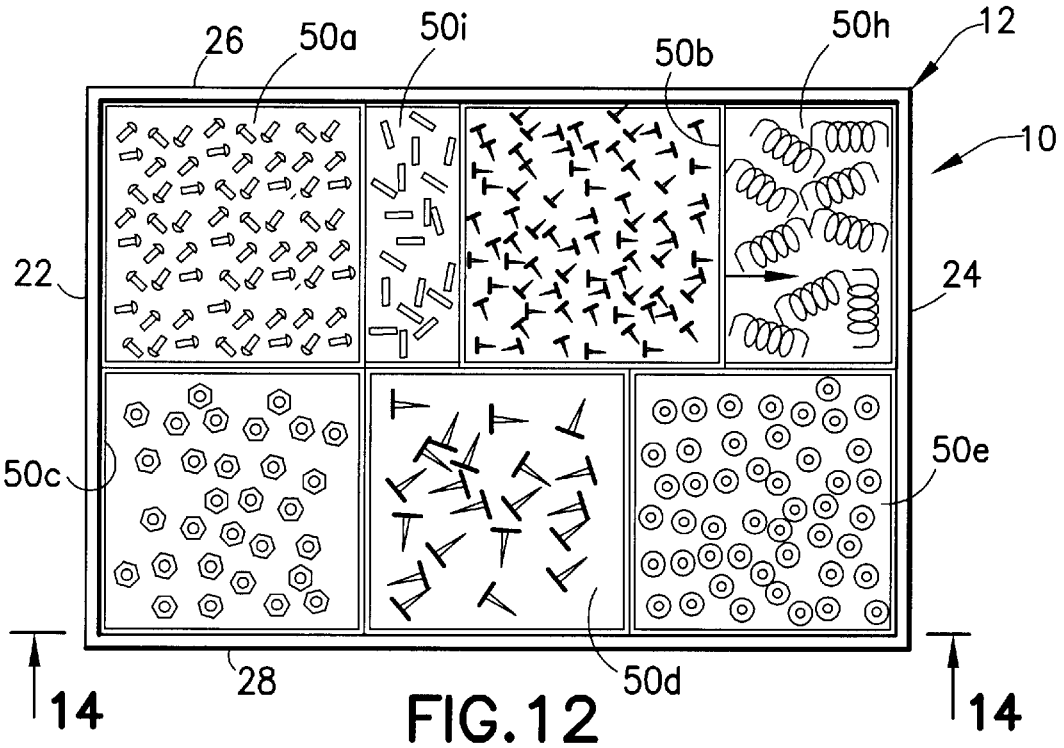
FIG. 12 is a top plan view of a container assembly with a plurality of inner containers movably supported therein.

The specific inner containers employed in either tier can be varied in accordance with the storage needs of the person employing the system 10. Various combinations of inner containers, 50, 60 and 70 can be employed by merely inserting and removing inner containers. Additionally, the relative outside dimensions of the bottom walls 52, 62 and 72 of the respective inner containers 50, 60 and 70 as compared to the corresponding inside dimensions of the inner containers 50, 60 and 70 enable an efficient stacking and also enable transverse sliding of the inner containers 50, 60 and 70. The sliding ability enables easy access to the contents of the inner containers 50, 60 and/or 70 disposed in the lower tier adjacent the bottom wall 20 of the outer container 12. This sliding ability is illustrated graphically in FIGS. 12 and 14. For example, FIG. 12 shows a first inner container 50*a* being slid parallel to the top edges 32–38 of the outer container 12 to enable access to a different inner container in the lower tier. At most, this accessibility requires a removal of one inner container from the upper tier, and transverse sliding of at least one of the other inner containers 50*b*–50*e*, as shown in FIG. 12.

Figure 13:
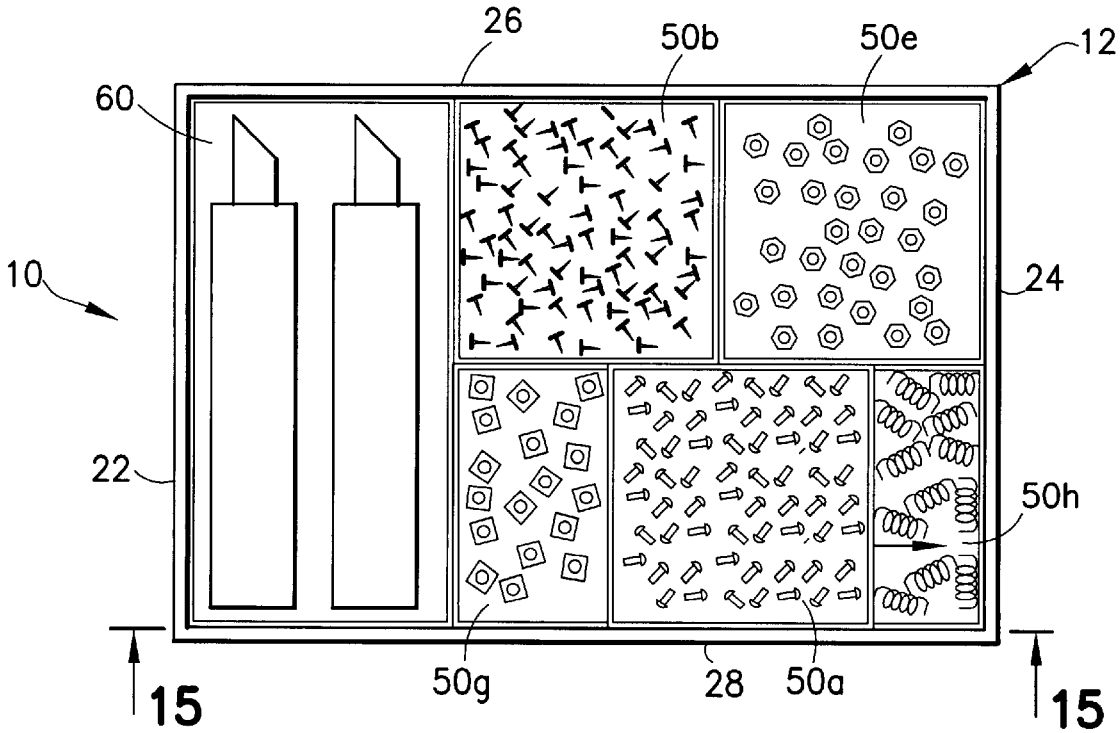
FIG. 13 is a top plan view of the container assembly with a different plurality of internal containers therein.

FIG. 13 shows the same operational features of FIG. 12, but with a different arrangement of inner containers. In particular, FIG. 13 shows a second inner container 60 supported in an upper tier on at least one other inner container 50, 60 or 70. FIGS. 12 and 13 also show the optional storage features enabled by the various inner containers. In particular, each of the first inner containers 50*a*–50*e* can be used to store small parts, such as nails, screws, bolts or washers. The second inner container 60 shown in FIG. 13 is appropriately dimensioned to accommodate six conventional caulking tubes, two of which are illustrated in FIG. 13.

Figure 14:
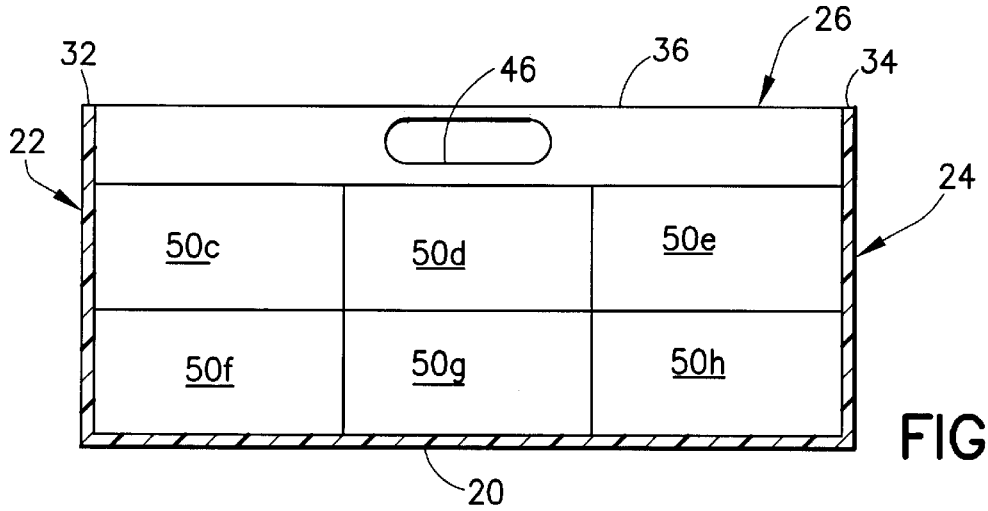
FIG. 14 is a cross-sectional view taken along line 14—14 in FIG. 12.
Figure 15:
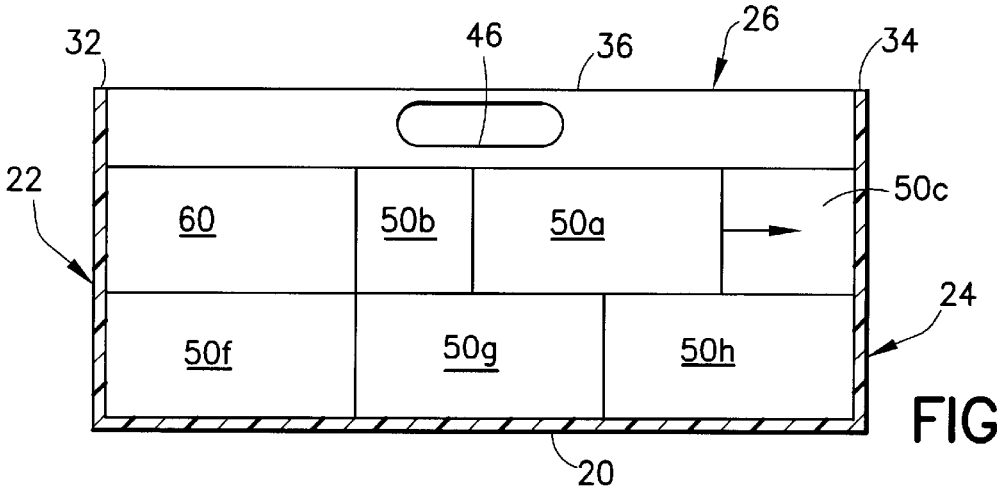
FIG. 15 is a cross-sectional view taken along line 15—15 in FIG. 13.

FIGS. 14 and 15 illustrate the supporting of the second tier of inner containers 50*b*–50*d* on a lower tier of first inner containers 50*f*–50*h*. FIG. 15 shows the supporting function of the first inner container 50*e* during sliding transverse movement on the first inner containers 50*f*–50*h*.

Figure 16:
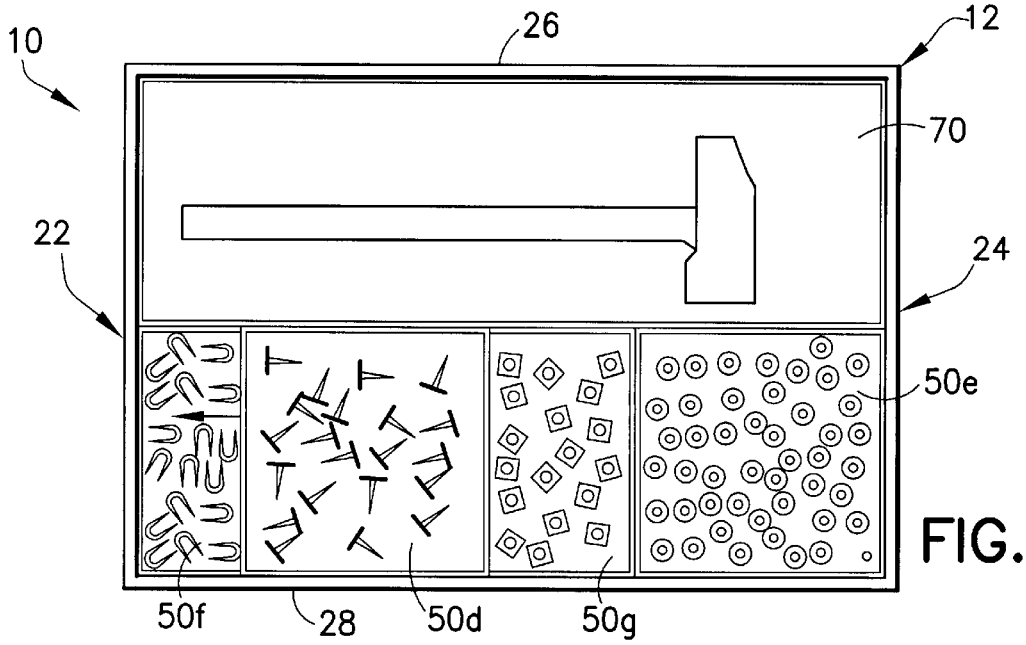
FIG. 16 is a top plan view of the container assembly with a different plurality of inner containers therein.

FIG. 16 shows the disposition of the third inner container 70 lengthwise within the outer container 12. The third inner container 70 is appropriately dimensioned to accommodate larger items, such as a hammer, a hacksaw or another comparably dimensioned hand tool. FIG. 16 also further illustrates the slidability of inner containers in the top tier relative to inner containers in the lower tier.

Figure 17:
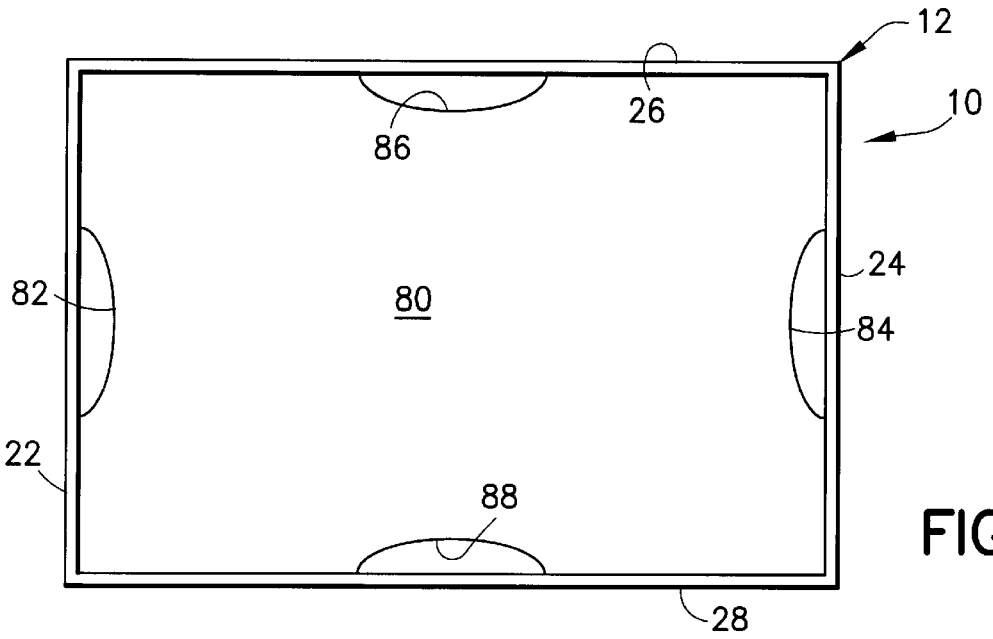
FIG. 17 is a top plan view of the container assembly with the cover in place.
Figure 18:
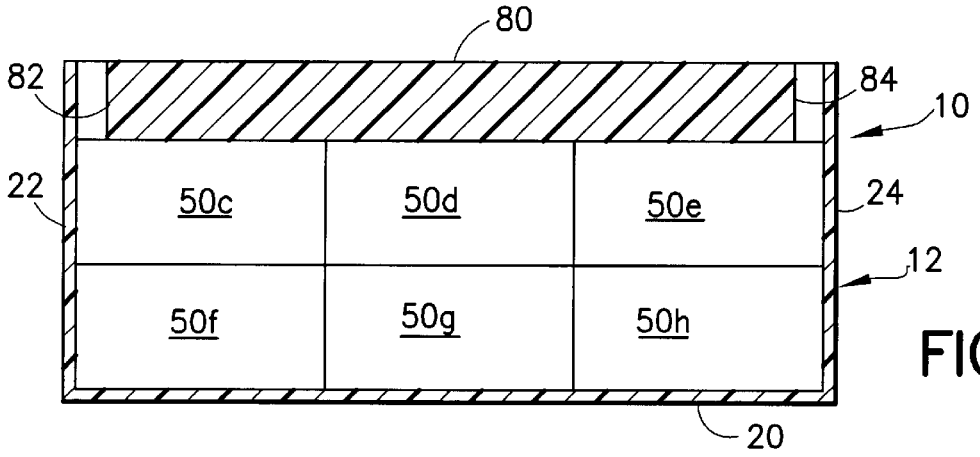
FIG. 18 is a cross-sectional view taken along line 18—18 in FIG. 17.

As noted above, two tiers of inner containers will define a total height 2Y substantially equal to the distance between the bottom wall 20 of the outer container 12 and the lower edge of the hand grips 42–48. This leaves a distance Z between the lower edge of the hand grips and the upper edges 32–38 of the sidewalls 22–28 of the outer container 12. This space can be used for several other optional members. In particular, FIGS. 17 and 18 show a cover 80 positioned in the outer container 12 and supported on an upper tier of inner containers 50, 60 and/or 70. The cover 80 has a maximum length of approximately 3X and a maximum width of approximately 2X to enable efficient telescoping of the cover 80 into the open top of the outer container 12. However, the cover 80 may further have a top lip to overlie the top edges of the sidewalls of the outer container 12. The cover 80 also may include gripping apertures at intermediate locations to facilitate gripping and lifting of the cover 80. The cover 80 further has hand gripped recesses 82–88 aligned with the respective hand grips 42–48 of the outer container 12. The recesses 82 enable the entire system 10 to be lifted with the cover 80 in place and further facilitates selective removal of the cover 80 from the outer container 12. As shown most clearly in FIG. 18, the cover 80 has a thickness Z to enable the upper surface of the cover 80 to substantially align with the top edges 32–38 of the sidewalls 22–28 of the outer container 12. Thus, the cover 80 enables efficient use of the system as a bench on which a person may sit while performing work. Alternatively, the top surface of the cover 80 can be employed as a work surface.

Figure 19:
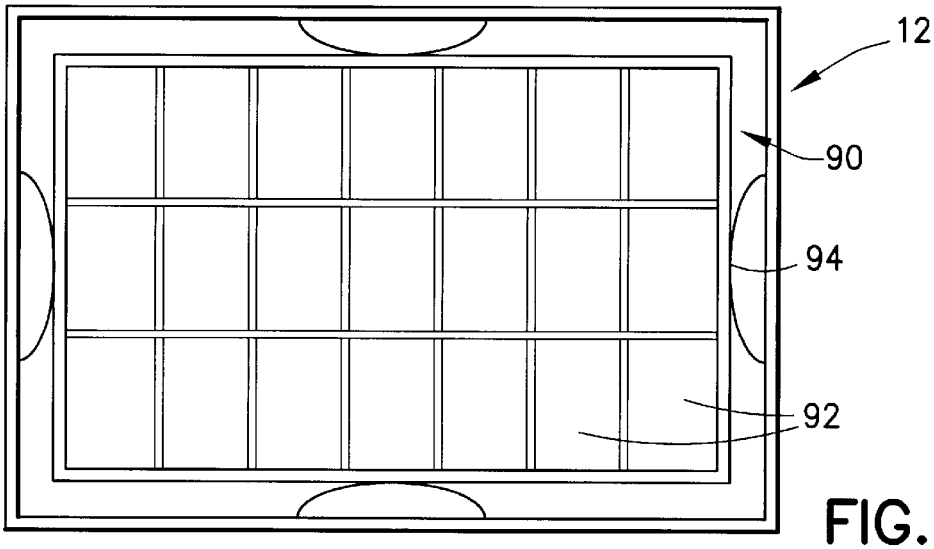
FIG. 19 is a top plan view of the container assembly with a top tray therein.

FIG. 19 shows an insert 90 that can be inserted into the open top of the outer container 12 and supported by an upper tier of inner containers 50, 60 and/or 70. The insert 90 is formed with a plurality of small receptacles 92 therein for storage of very small items or items that require only a small inventory. The insert 90 also functions as a cover for the inner containers 50, 60 and 70. Removal of the insert 90 to access the inner containers 50, 60 and/or 70 is facilitated by recesses 94 along side and end edges thereof. The recesses 94 are disposed to register with the hand grips 42–48 to enable the entire system to be lifted with the insert 90 in place.

While the invention has been described with respect to certain preferred embodiments, various changes can be made without departing from the scope of the invention as defined by the appended claims. In particular, combinations of inner containers other than those shown herein may be employed. Also, a plurality of the systems 10 may be used in abutting relationship with a plurality of interconnected covers to define a single large seating surface or a single large working surface. Additionally, the common cover for a plurality of systems enables the systems to be supported in side-by-side relationship in the back of a truck or in a van so that other materials may be stored on top and so that a worker may climb over the stored systems to access other material in the truck or van. Additionally, a combination of the cover shown in FIG. 17 and the insert shown in FIG. 19 can be provided merely by making each of these elements thinner. Thus, a receptacle insert can be positioned on the upper tier of inner containers 50, 60 and/or 70 and a slightly thinner cover can be positioned over the receptacle insert. The cover can be removed or lifted to access the receptacles in the receptacle insert. Alternatively the cover may be hinged to a portion of the receptacle insert for achieving efficient access. These and other changes will be apparent to a person skilled in the art after having read the subject disclosure.

What is claimed is:

1. A storage container assembly comprising:

a plurality of substantially rectangular open-topped inner containers, each said inner container having a bottom defined by a planar rectangular bottom wall, a pair of opposed substantially identical end walls extending perpendicularly upwardly from the bottom wall of the respective inner container and a pair of opposed substantially rectangular sidewalls extending perpendicularly upwardly from the bottom wall of the respective inner container, each of said side and end walls of each of said open-topped inner containers having a top edge, said top edges of said side and end walls defining an open top for each said open-topped inner container, each said inner container defining an outside width substantially equal to a selected width dimension and an outside length substantially equal to a selected integer multiple of the selected width dimension, the outside width adjacent the bottom wall of each said container being greater than an inside width adjacent said top edges of said container to prevent said containers from nesting in one another, each said inner container further defining a height equal to a selected height dimension; and a substantially rectangular open-topped outer container unitarily molded from a plastic material and having a bottom wall with an inner surface, a pair of opposed rectangular end walls extending perpendicularly from the bottom wall of the outer container and a pair of opposed rectangular sidewalls extending perpendicularly from the bottom wall of the outer container, the side walls being spaced from one another by substantially twice the selected width dimension, the end walls being spaced from one another by a selected integer multiple of the selected width dimension, a hand grip opening formed in each of the end walls of the outer container at locations centrally between the respective sidewalls, each hand grip opening having opposed upper and lower surfaces, the upper surface of each hand grip opening being more than twice the selected height dimension from the inner surface of the bottom wall of the outer container; and wherein the inner containers define a lower tier of inner containers slidably supported on the inner surface of the bottom wall of the outer container and an upper tier of inner containers having the planar bottom walls slidably supported on the lower tier of inner containers and thereby disposed lower than the upper surface of the hand grip openings, thereby facilitating access to contents of the respective inner containers.

2. The assembly of claim 1, wherein the lower surface of each such hand grip opening is at least twice the selected height dimension from the inner surface of the bottom wall of the outer container.

3. The assembly of claim 1, wherein the end walls of the outer container are spaced from one another by three times the selected width dimension.

4. The assembly of claim 1, wherein at least two of the inner containers define an outside length substantially equal to the selected width dimension.

5. The assembly of claim 1, wherein at least one of the inner containers define an outside length of approximately twice the selected width dimension.

6. The assembly of claim 1, wherein at least one of the inner containers has a diagonal insert extending between diagonally opposed corners of the inner container for dividing the inner container into two substantially triangular inner container halves.

7. The assembly of claim 1, wherein the outer container is unitarily molded from a plastic material and has the bottom wall, the sidewalls and the end walls thereof being at least partly of lattice construction.

8. The assembly of claim 7, wherein the inner containers each are unitarily formed of galvanized metal.

* * * * *